US012440081B2

(12) United States Patent
Liu et al.

(10) Patent No.: US 12,440,081 B2
(45) Date of Patent: Oct. 14, 2025

(54) CLEANING ASSEMBLY AND SMART CLEANING DEVICE

(71) Applicant: Beijing Roborock Technology Co., Ltd., Beijing (CN)

(72) Inventors: Xiaoming Liu, Beijing (CN); Erdong Gu, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 654 days.

(21) Appl. No.: 17/641,078

(22) PCT Filed: Aug. 18, 2020

(86) PCT No.: PCT/CN2020/109844
§ 371 (c)(1),
(2) Date: Mar. 7, 2022

(87) PCT Pub. No.: WO2021/042984
PCT Pub. Date: Mar. 11, 2021

(65) Prior Publication Data

US 2022/0330780 A1 Oct. 20, 2022

(30) Foreign Application Priority Data

Sep. 5, 2019 (CN) ..... 201910839233.3

(51) Int. Cl.
*A47L 11/40* (2006.01)

(52) U.S. Cl.
CPC ..... *A47L 11/4036* (2013.01); *A47L 2201/00* (2013.01)

(58) Field of Classification Search
CPC .... A47L 11/408; A47L 9/0686; A47L 9/4016; A47L 2201/00; A47L 11/4036; A47L 11/325; A47L 11/32
(Continued)

(56) References Cited

U.S. PATENT DOCUMENTS 2,078,101 A 4/1937 Schmermund
3,992,747 A 11/1976 Hufton
(Continued)

FOREIGN PATENT DOCUMENTS

CN 204133376 U 2/2015
CN 204813712 U 12/2015
(Continued)

OTHER PUBLICATIONS

Communication from European Application No. 20860746.5 dated Sep. 18, 2023.
(Continued)

*Primary Examiner* — Tom Rodgers
(74) *Attorney, Agent, or Firm* — Calfee, Halter & Griswold LLP

(57) ABSTRACT

The present disclosure relates to a cleaning assembly and a smart cleaning device. The cleaning assembly is capable of being mounted on a machine body of a smart cleaning device and includes a connecting plate and a soft cleaning body, wherein the connecting plate and the soft cleaning body are detachably connected through a slide assembly, the slide assembly includes a mounting groove and a guide bar which are mutually matched, the mounting groove is provided on one of the connecting plate and the soft cleaning body, and the guide bar is disposed on the other one of the connecting plate and the soft cleaning body.

15 Claims, 6 Drawing Sheets

(58) Field of Classification Search
USPC ..... 15/4
See application file for complete search history.

(56) References Cited

U.S. PATENT DOCUMENTS

| | | | | |
|---|---|---|---|---|
| 2006/0059639 | A1 | 3/2006 | Stackpole et al. | |
| 2011/0108067 | A1 | 5/2011 | Shinler et al. | |
| 2012/0304416 | A1* | 12/2012 | Nguyen | A47L 11/4091 705/500 |
| 2016/0150934 | A1 | 6/2016 | Jihwan et al. | |

FOREIGN PATENT DOCUMENTS

| | | | |
|---|---|---|---|
| CN | 205018991 | U | 2/2016 |
| CN | 105433871 | A | 3/2016 |
| CN | 106108776 | A | 11/2016 |
| CN | 205683035 | U | 11/2016 |
| CN | 206355004 | U | 7/2017 |
| CN | 107007219 | A | 8/2017 |
| CN | 106108776 | B | 12/2018 |
| CN | 109363571 | A | 2/2019 |
| CN | 208582332 | U | 3/2019 |
| CN | 208659179 | U | 3/2019 |
| CN | 208988721 | U | 6/2019 |
| CN | 110448234 | A | 11/2019 |
| CN | 110537875 | A | 12/2019 |
| CN | 210931184 | U | 7/2020 |
| CN | 210931185 | U | 7/2020 |
| EP | 2329755 | A2 | 6/2011 |
| JP | 2009509220 | A | 3/2009 |
| KR | 101253639 | B1 | 4/2013 |
| WO | 2018137405 | A1 | 8/2018 |
| WO | 2018137407 | A1 | 8/2018 |
| WO | 2018137408 | A1 | 8/2018 |
| WO | 2018149311 | A1 | 8/2018 |

OTHER PUBLICATIONS

PCT, International Search Report for PCT/CN2020/109844, Aug. 18, 2020.
TW, Office Action for Taiwanese Application No. 109129649, Apr. 29, 2021.
Office action from Japanese Application No. 2022-514858 dated Apr. 11, 2023.
First Office Action for Chinese Application No. 201910839233.3 dated Mar. 7, 2024.
Search Report for Eurasian Application No. 202392815 dated Mar. 4, 2024.
1st Office Action Japanese Patent No. 2023-176876 dated May 28, 2024.
Notice of Allowance of application No. 2023-176876 dated Sep. 17, 2024.

* cited by examiner

CLEANING ASSEMBLY AND SMART CLEANING DEVICE

CROSS REFERENCE TO RELATED APPLICATIONS

This application is a United States national phase of a Patent Cooperation Treaty (PCT) application PCT/CN2020/109844 filed on Aug. 18, 2020, which claims priority to Chinese Patent Application No. 201910839233.3 filed on Sep. 5, 2019, which is are incorporated herein by reference in their entireties.

TECHNICAL FIELD

The present disclosure relates to the technical field of smart cleaning devices, and in particular, to a cleaning assembly and a smart cleaning device.

BACKGROUND

With the development of technologies, various autonomous cleaning devices, such as an autonomous sweeping robot, an autonomous mopping robot, and a smart cleaning robot with both an automatic sweeping function and an automatic mopping function, and the like. The autonomous cleaning device may automatically perform cleaning to bring convenience to a user. By using the autonomous sweeping robot with the automatic mopping function and the automatic sweeping function as an example, during mopping operation, usually a liquid containing box is required to be disposed on the smart cleaning robot to provide a liquid source required for mopping. A liquid containing box of an existing smart cleaning robot is located at a bottom portion of a machine body of the smart cleaning robot and is connected to the machine body of the smart cleaning robot. Typically, cleaning cloth and the liquid containing box are required to be detached together when replacing the cleaning cloth, and in a case of detaching the liquid containing box, a bottom surface of the smart cleaning robot is required to be turned upside down before mounting or detaching the liquid containing box. In a case of mounting and detaching the liquid containing box in this way, the smart cleaning robot is required to be turned upside down, which may easily cause collision and damages to a top surface of the smart cleaning robot, and may further easily damage a sensor on the top surface of the smart cleaning robot, resulting in relatively great economic loss. In addition, if there is a leakage in the liquid containing box, a leaked liquid may directly flow to an inner portion of the smart cleaning robot through gaps in the bottom surface during mounting and detaching of the liquid containing box, thereby causing damages to circuits and components inside the smart cleaning robot to generate irreparable problems.

SUMMARY OF THE DISCLOSURE

According to an aspect, an embodiment of the present disclosure provides a cleaning assembly, capable of being mounted on a machine body of a smart cleaning device, where the cleaning assembly includes a connecting plate and a flexible cleaning body, the cleaning assembly is detachably connected to the machine body through a connecting plate, and in a case that the connecting plate is mounted into or removed from the machine body, the connecting plate moves in a forward direction or backward direction of the machine body; the connecting plate and the soft cleaning body are detachably connected through a slide assembly, the slide assembly includes a mounting groove and a guide bar which are mutually matched, the mounting groove is provided on one of the connecting plate and the soft cleaning body, and the guide bar is disposed on the other one of the connecting plate and the soft cleaning body; and the guide bar is operatively inserted into the mounting groove to connect the soft cleaning body to the connecting plate, and operatively gets out of the mounting groove to separate the soft cleaning body from the connecting plate.

According to another aspect, an embodiment of the present disclosure provides a smart cleaning device, including a cleaning assembly. The cleaning assembly, capable of being mounted on a machine body of a smart cleaning device, wherein the cleaning assembly comprises a connecting plate and a soft cleaning body, the cleaning assembly is detachably connected to the machine body through the connecting plate, and in a case that the connecting plate is mounted into or removed from the machine body, the connecting plate moves in a forward direction or a backward direction of the machine body; the connecting plate and the soft cleaning body are detachably connected through a slide assembly which comprises a mounting groove and a guide bar which are mutually matched, the mounting groove is provided on one of the connecting plate and the soft cleaning body, and the guide bar is disposed on the other one of the connecting plate and the soft cleaning body; and the guide bar is operatively inserted into the mounting groove to connect the soft cleaning body to the connecting plate, and operatively gets out of the mounting groove to separate the soft cleaning body from the connecting plate.

BRIEF DESCRIPTION OF THE DRAWINGS

The features, the advantages and technical effects of exemplary embodiments of the present disclosure will be described below with reference to the accompanying drawings. It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

In the drawings.

Figure 1:
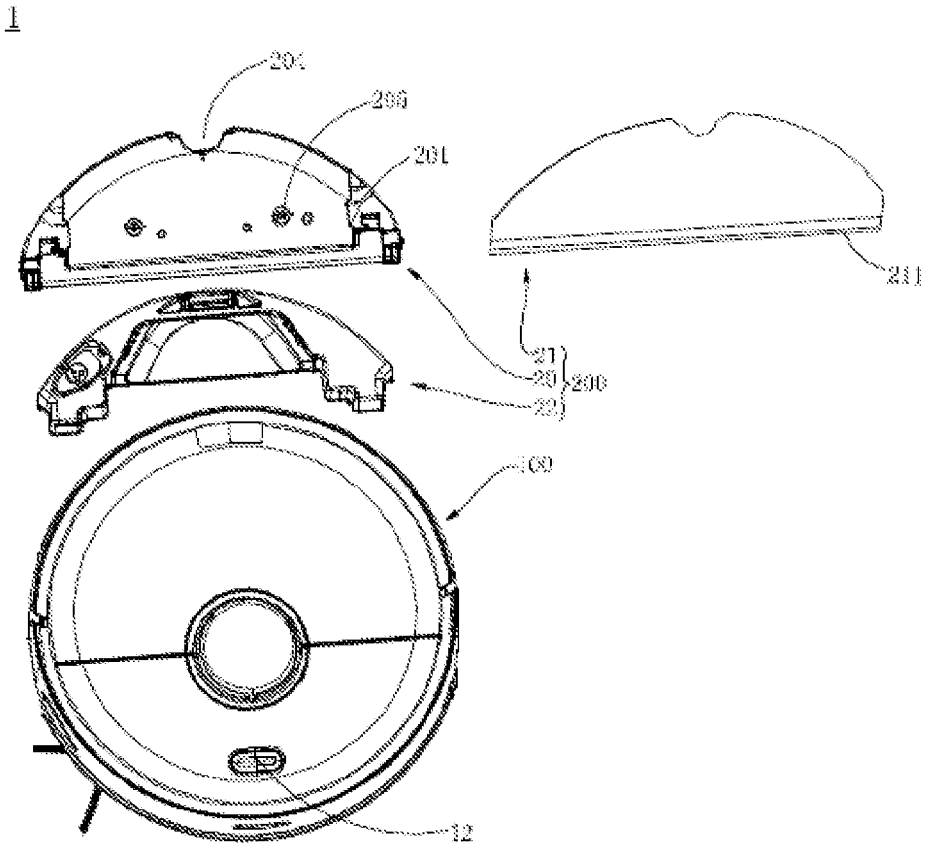
FIG. 1 illustrates an exploded view of a smart cleaning device according to an embodiment of the present disclosure.

1. Smart cleaning robot;

100. Machine body;

10. Drive system; 101. Drive wheel module; 102. Driven wheel;

11. Cliff sensor;

12. Human-machine interaction system;

13. Dry cleaning portion; 131. Brushroll; 132. Side brush;

14-Front portion;

15-Rear portion;

16-Fan mounting position;

200. Cleaning assembly;

20. Support plate; 201. Guide protrusion; 202. Second hook; 203. Mounting groove; 204. Notch; 205. Elastic part; 206. Water through hole; 207. Mounting opening;

21. Cleaning cloth; 211. Guide bar;

22. Water tank; 221. Guide groove; 222. First hook;

23. Control structure; 231. Mounting frame; 232. Operating part;

24. Button;

25. Same-course water path plate; and 251. Water outlet.

In the drawings, the same reference numerals are used to designate same or similar components. The drawings are not drawn to actual scale.

DETAILED DESCRIPTION OF THE PREFERRED EMBODIMENTS

Features and exemplary embodiments of various aspects of the present disclosure will be described in detail below. In the following description, numerous specific details are described to provide a thorough understanding of the present disclosure. However, it would be obvious to one of ordinary skill in the art that the present disclosure may be practiced without some of these specific details herein. The following description of the embodiments is merely for providing a better understanding of the present disclosure by illustrating embodiments of the present disclosure. In the drawings and the description below, at least part of well-known structures and techniques are not illustrated, to avoid unnecessarily obscuring the present disclosure; and dimensions of some structures may be exaggerated for clarity. Furthermore, the described features, structures or characteristics below may be combined in any suitable manner in one or more embodiments.

The direction words appearing in the following description illustrate directions in the drawings, and do not limit specific structures of the cleaning assembly 200 and the smart cleaning device of the present disclosure. In the description of the present disclosure, it should further be noted that the terms "mounting" and "connecting" should be understood in a broad sense unless specified and limited otherwise, for example, the term "connecting" may indicate fixed connecting or detachable connecting, or integrated connecting, or direct connecting or indirect connecting. For one of ordinary skill in the art, specific meanings of the above terms in the present disclosure can be understood according to specific situations.

Embodiments of the present disclosure provides a smart cleaning device, by which every time a soft cleaning body is replaced, a liquid containing box is not required to be removed, and the soft cleaning body can be removed by only detaching a connecting plate in a forward or backward direction of a machine body, thereby facilitating operation while avoiding damages easily caused to the smart cleaning device by removing of the liquid containing box of the prior art.

To better understand the present disclosure, the smart cleaning device and the cleaning assembly 200 according to embodiments of the present disclosure will be described in detail below with reference to FIG. 1 to FIG. 12.

Figure 2:
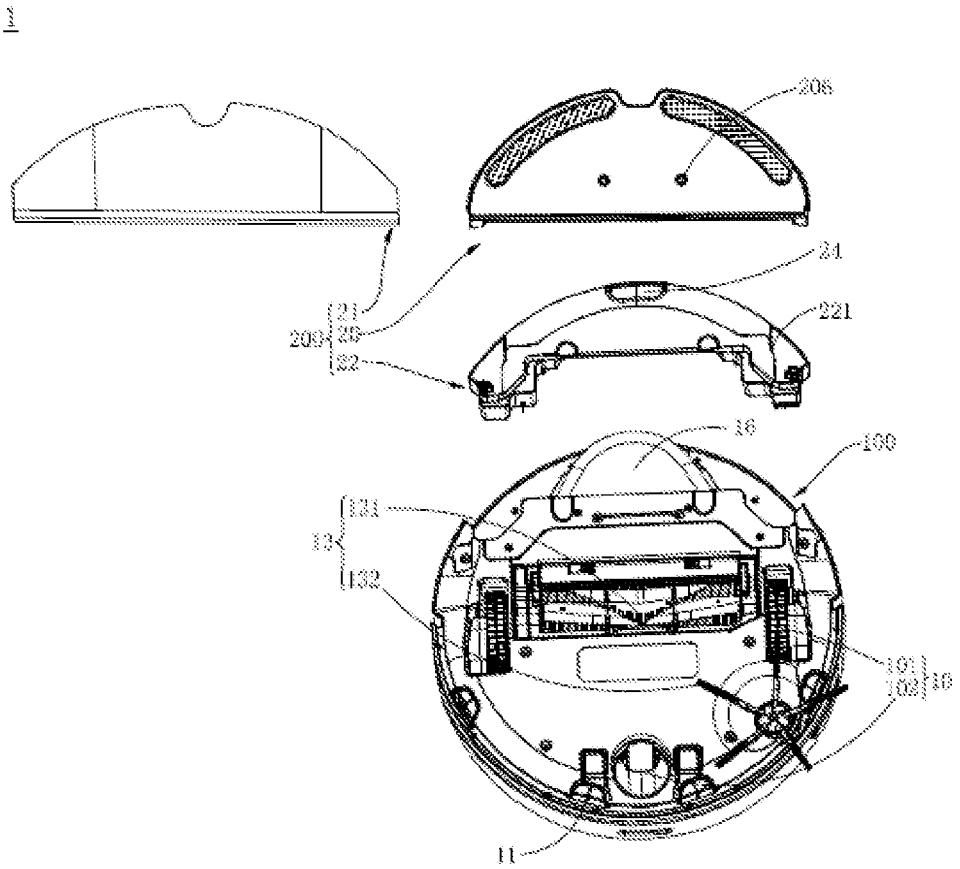
FIG. 2 illustrates an exploded view of a smart cleaning device from another viewing angle according to an embodiment of the present disclosure.
Figure 3:
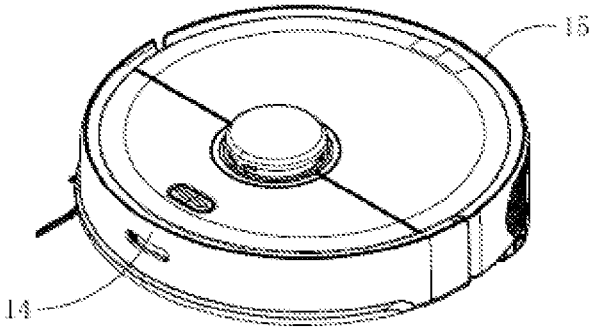
FIG. 3 illustrates an axonometric view of a smart cleaning device according to an embodiment of the present disclosure.
Figure 4:
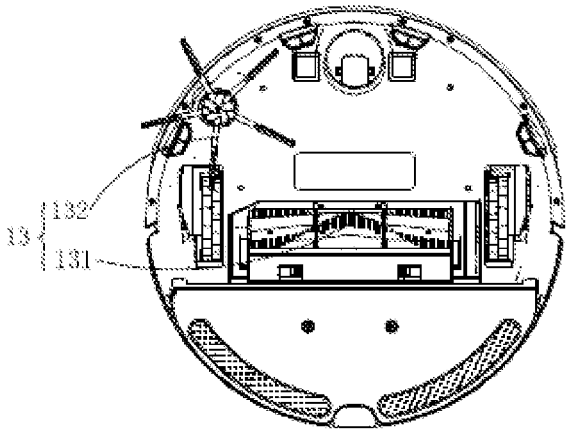
FIG. 4 illustrates an axonometric view of a smart cleaning device with a soft cleaning body removed from another viewing angle according to an embodiment of the present disclosure.
Figure 5:
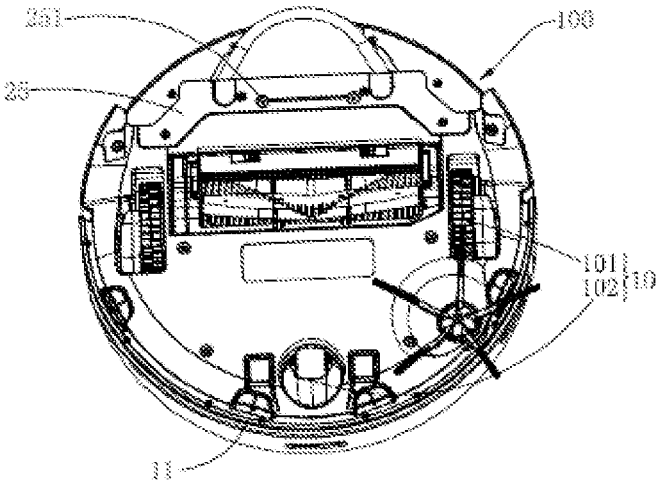
FIG. 5 illustrates an axonometric view of a machine body according to an embodiment of the present disclosure.
Figure 6:
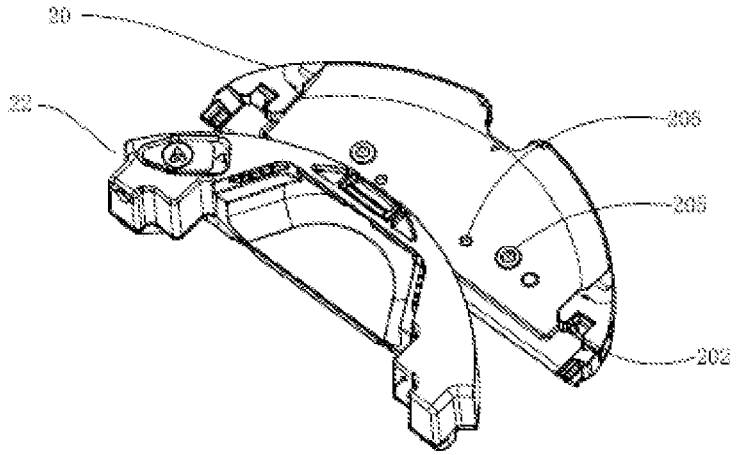
FIG. 6 illustrates an exploded view illustrating a connecting structure between a support plate and a water tank according to an embodiment of the present disclosure.
Figure 7:
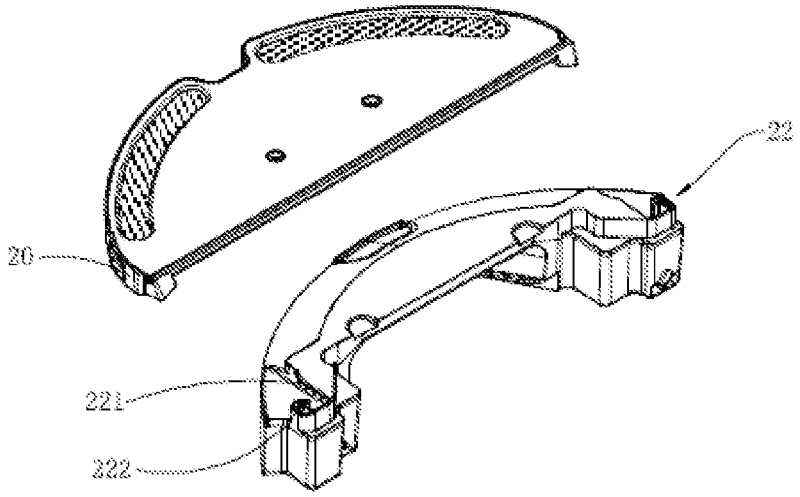
FIG. 7 illustrates an exploded view illustrating a connecting structure of a support plate and a water tank from another angle according to an embodiment of the present disclosure.
Figure 8:
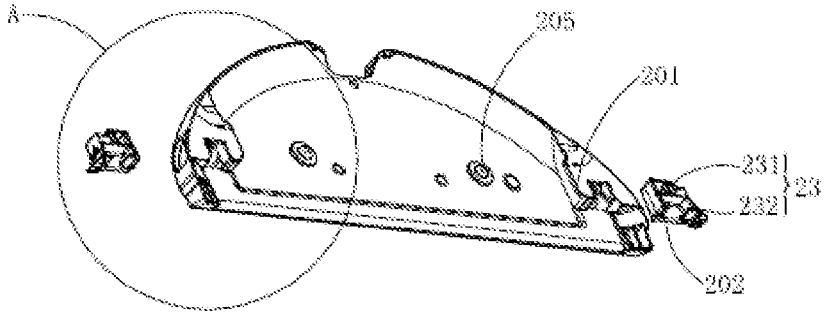
FIG. 8 illustrates an exploded view illustrating a connecting structure between a support plate and a control structure disposed on the support plate according to an embodiment of the present disclosure.
Figure 9:
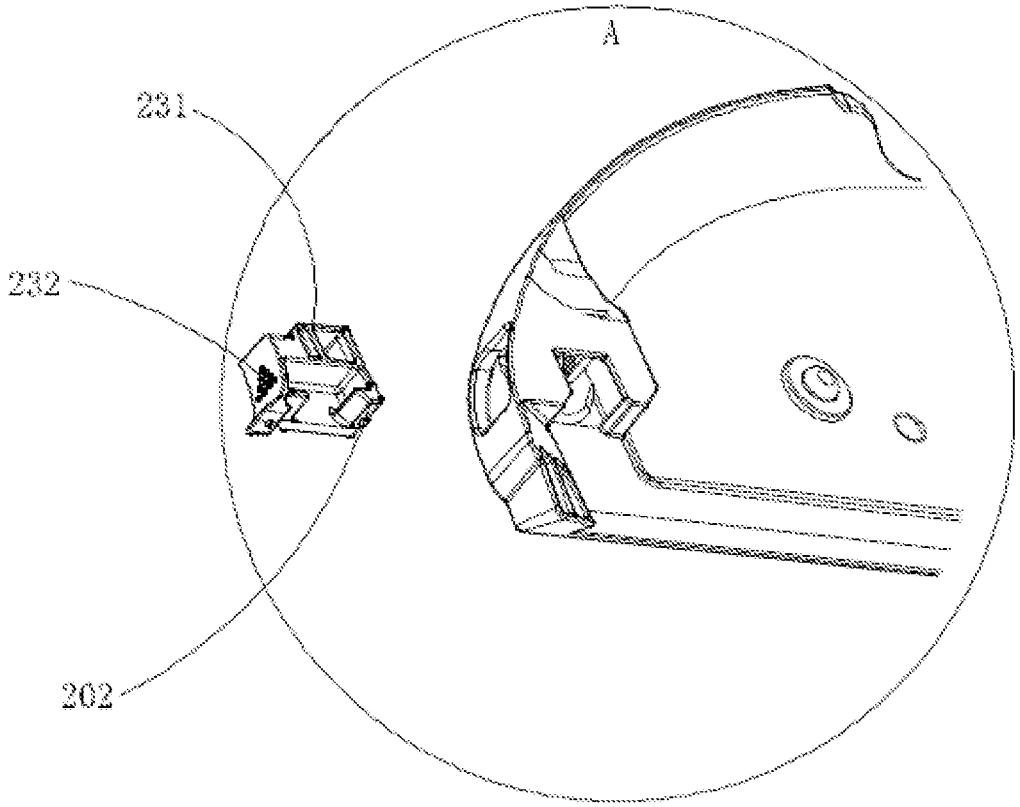
FIG. 9 illustrates an enlarged view of a partial structure at a position A in FIG. 8.
Figure 10:
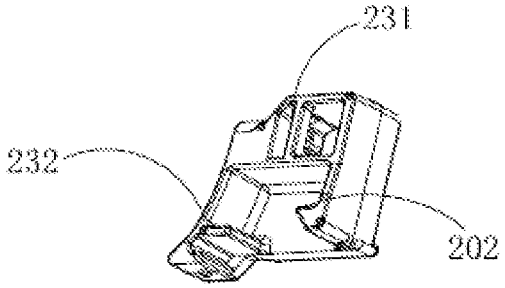
FIG. 10 illustrates a schematic structural view of an integrated structure of a second hook and a control structure according to an embodiment of the present disclosure.
Figure 11:
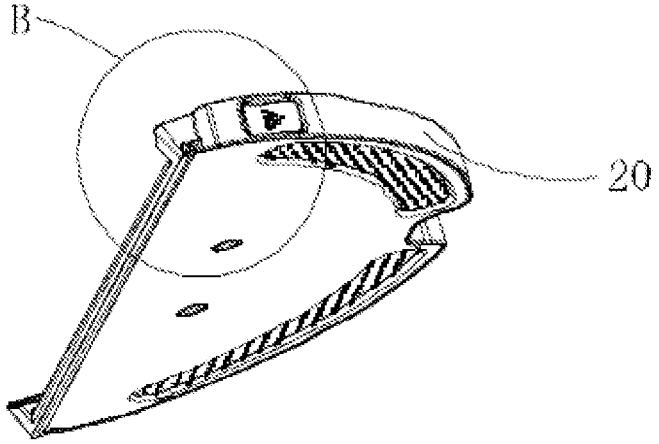
FIG. 11 illustrates a schematic structural view of a connecting structure of a support plate and a control structure disposed on the support plate according to an embodiment of the present disclosure.
Figure 12:
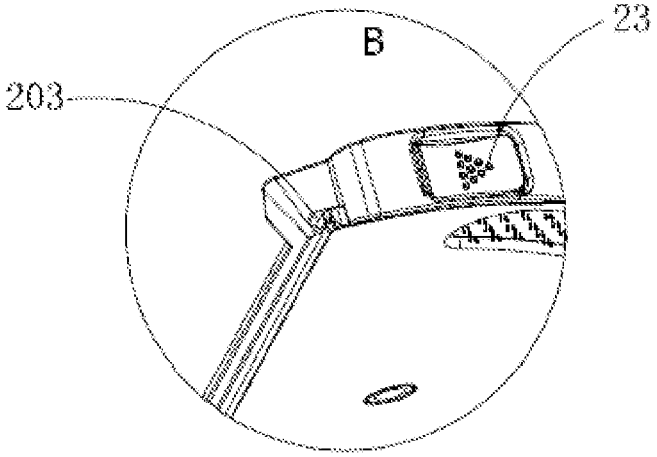
FIG. 12 illustrates an enlarged view of a partial structure at a position B in FIG. 11.

Referring to FIG. 1 to FIG. 12, FIG. 1 illustrates an exploded view of a smart cleaning device according to an embodiment of the present disclosure; FIG. 2 illustrates an exploded view of a smart cleaning device from another viewing angle according to an embodiment of the present disclosure; FIG. 3 illustrates an axonometric view of a smart cleaning device according to an embodiment of the present disclosure; FIG. 4 illustrates an axonometric view of a smart cleaning device from another angle according to an embodiment of the present disclosure; FIG. 5 illustrates an axonometric view of a machine body 100 according to an embodiment of the present disclosure; FIG. 6 illustrates an exploded view of a connecting structure of a support plate 20 and a water tank according to an embodiment of the present disclosure; FIG. 7 illustrates an exploded view of a connecting structure between a support plate 20 and a water tank from another viewing angle according to an embodiment of the present disclosure; FIG. 8 illustrates an exploded view of a connecting structure between a support plate 20 and a control structure 23 disposed on the support plate 20 according to an embodiment of the present disclosure; FIG. 9 illustrates an enlarged view of a partial structure at a position A in FIG. 8; FIG. 10 illustrates a schematic structural view of an integrated structure of a second hook 202 and a control structure 23 according to an embodiment of the present disclosure; FIG. 11 illustrates a schematic structural view of a connecting structure between a support plate 20 and a control structure 23 disposed on the support plate 20 according to an embodiment of the present disclosure; and FIG. 12 illustrates an enlarged view of a partial structure at a position B in FIG. 11.

Terminologies:

Forward: A forward direction of a smart cleaning device.

Backward: A direction opposite to the forward direction of the smart cleaning device.

Referring to FIG. 1 to FIG. 7, a smart cleaning device according to an embodiment of the present disclosure includes a machine body 100 and a cleaning assembly 200. The machine body 100 is configured to carry various functional components of the smart cleaning device. The cleaning assembly 200 is detachably disposed on the machine body 100. In a case that the cleaning assembly 200 is mounted into or detached from the machine body 100, the cleaning assembly 200 may move in the forward or the backward direction of the machine body 100. In some optional embodiments of the present disclosure, the cleaning assembly 200 includes a liquid containing box, a connecting plate, and a soft cleaning body which are arranged in a stacked mode. The connecting plate is mounted at a bottom portion of the liquid containing box through a guide structure, and after the connecting plate is mounted at the bottom portion of the liquid containing box, the connecting plate is capable of floating upward or downward relative to the liquid containing box. In some optional embodiments of the present disclosure, the smart cleaning device is a smart cleaning robot 1, the connecting plate is a support plate 20, the soft cleaning body is a cleaning cloth 21, and the liquid containing box is a water tank 22.

For the smart cleaning device according to the embodiment of the present disclosure, in some optional embodiments of the present disclosure, the guide structure includes a guide protrusion 201 and a guide groove 221 which are mutually matched. The guide protrusion 201 is disposed on the support plate 20. The guide groove 221 is disposed on the water tank 22. A thickness of the guide protrusion 201 is less than a depth of the guide groove 221, so that the support plate 20 is capable of floating upward or downward relative to the water tank 22 after being mounted at the bottom portion of the water tank 22. Optionally, the thickness of the guide protrusion 201 refers to a thickness of the guide protrusion 201 in a height direction of the smart cleaning robot 1, and the depth of the guide groove 221 refers to a depth of the guide groove 221 in the height direction of the smart cleaning robot 1.

It should be understood that the guide structure is not limited to the above structure, and the structure of the guide structure may further be configured in a way that the guide structure includes a guide protrusion 201 and a guide groove 221 which are mutually matched, wherein the guide protrusion 201 is disposed on the water tank 22, the guide groove 221 is formed in the support plate 20, where a thickness of the guide protrusion 201 is less than a depth of the guide groove 221, so that the support plate 20 is capable of floating upward and downward relative to the water tank 22 after being mounted at the bottom portion of the water tank 22. The thickness of the guide protrusion 201 specifically refers to a thickness of the guide protrusion 201 in a height direction of the smart cleaning robot 1, and the depth of the guide groove 221 refers to a depth of the guide groove 221 in the height direction of the smart cleaning robot 1. The design of the guide structure is only required to meet mounting requirements of the water tank 22 and the support plate 20, and to ensure that the support plate 20 is movable in the forward direction or the backward direction of the smart cleaning robot 1. Optionally, the design of the guide structure is further required to satisfy that after the support plate 20 capable of floating upward or downward to the water tank 22 after the support plate 20 being mounted on the water tank 22.

In the smart cleaning device according to the embodiment of the presents of disclosure, the cleaning assembly 200, as a whole, is removable from the machine body 100 of the smart cleaning robot 1 in the forward direction or the backward direction of the smart cleaning robot 1, and the support plate 20 is also removable from the main body of the smart cleaning robot 1 independently in the forward direction or the backward direction of the smart cleaning robot 1.

Further referring to FIG. 6 and FIG. 7, in the smart cleaning device according to the embodiments of the present disclosure, further, the support plate 20 is connected to the water tank 22 through a connecting structure after the support plate is mounted on the water tank 22. The connecting structure includes a first connecting structure and a second connecting structure which are disposed on the water tank 22 and the support plate 20, respectively, and mutually matched. In some optional embodiments of the present disclosure, the first connecting structure is a first hook 222 disposed on the water tank 22, and the second connecting structure is a second hook 202 disposed on the support plate 20. After the support plate 20 is mounted at the bottom portion of the water tank 22 through the guide structure, the first hook 222 and the second hook 202 may be mutually clamped, to achieve a stable connection between the support plate 20 and the water tank 22.

Further referring to FIG. 8 to FIG. 12, optionally, the connecting structure further includes a control structure 23 which is disposed on the support plate 20 and is configured to control the first hook 222 and the second hook 202 to be connected with each other and to be separated from each other. In some optional embodiments of the present disclosure, the control structure 23 and the second hook 202 are integrated. The control structure 23 includes a mounting frame 231, wherein the mounting frame 231 is movably disposed on the support plate 20, and the second hook 202 is connected to an end of the mounting frame 231, so that the second hook 202 is capable of moving to a stop position or an escaping position under drive of the mounting frame 231; and an operating part 232, disposed at the other end of the mounting frame 231 and opposite to the second hook 202, so as to control the mounting frame 231 to move. The operation process is as follows: in a case that the operating part 232 is pressed towards an inner part of the machine body of the smart cleaning robot 1, the whole control structure 23 moves towards the inner part of the machine body of the smart cleaning robot 1, and in this case, the second hook 202 is driven by the control structure 23 to move towards the inner part of the body of the smart cleaning robot 1 to the escaping position, so that the first hook 222 is separated from the second hook 202; after the first hook 222 is separated from the second hook 202, the support plate 20 may be further removed from the water tank 22 along the guide structure conveniently. After the cleaning cloth 21 is replaced, and the support plate 20 is mounted at the bottom portion of the water tank 22 again, the second hook 202 is located at the stop position under limit of the guide protrusion 201, so that the first hook 222 and the second hook 202 are connected with each other, achieving a stable connection between the water tank 22 and the support plate 20.

In some optional embodiments of the present disclosure, the guide protrusion 201 is disposed on the support plate 20 and is of an elastic structural body. In a case that the second hook 202 moves to the escaping position, the guide protrusion 201 may be extruded by the second hook 202 to elastically deform, so that the first hook 222 is separated from the second hook 202. In a case that the second hook 202 moves to the stop position, the guide protrusion 201 is recovered to the original state, so that the first hook 222 is connected to the second hook 202.

It should be understood that the control structure 23 may be, but is not limited to, the above-mentioned structure. The control structure 23 may alternatively be disposed on the water tank 22, and may be optionally integrated with the first hook 222, so that the first hook 222 and the second hook 202 can be controlled to be connected with each other and to be separated from each other.

Further referring to FIG. 1, FIG. 2 and FIG. 12, in the smart cleaning device according to the embodiments of the present disclosure, the support plate 20 and the cleaning cloth 21 are detachably connected through a slide assembly. The slide assembly includes a mounting groove 203 and a guide bar 211 which are mutually matched. In some optional embodiments of the present disclosure, the mounting groove 203 is provided on the support plate 20, the guide bar 211 is disposed on the cleaning cloth 21, and the guide bar 211 may be inserted into the mounting groove 203 to connect the cleaning cloth 21 to the support plate 20, and may get out of the mounting groove 203 to separate the cleaning cloth 21 from the support plate 20. In this way, in a case that the cleaning cloth 21 is required to be removed, the cleaning cloth 21 can be directly removed from the support plate 20 for being replaced or washed, which facilitates operation, and further resolving the existing technical problem that great economic loss is further caused by irreparable problems due to damages to the sensors of the smart cleaning robot 1 and even to the circuits and components inside the smart cleaning robot 1 as the smart cleaning robot 1 is easily collided and damaged in a case of turning the smart cleaning robot 1 upside down for removing the water tank 22 along with the support plate 20 when replacing of the cleaning cloth 21. The support plate 20 is detachably connected to the water tank 22. In a case that the support plate 20 is mounted into or removed from the machine body 100, the support plate 20 moves in the forward direction or the backward direction of the machine body 100 for removing the cleaning cloth 21 together with the support plate 20 from the water tank 22 of the smart cleaning robot 1. In a case of being mounted into or removed from the water tank 22, the support plate 20 of the cleaning assembly 200 moves in the forward direction or backward direction of the machine body 100 and the forward direction or backward direction of the machine body 100 is typically the horizontal direction, so the support plate 20 with the cleaning cloth 21 is mounted and removed more conveniently. Further, the technical problem that the smart cleaning robot 1 is required to be turned upside down for dismounting the cleaning assembly 200 in the prior art is solved, and thus, the cleaning assembly 200 is replaced and maintained more conveniently. It can be understood that the smart cleaning device may be, but is not limited to, the smart cleaning robot 1. In some other optional embodiments, the smart cleaning device may alternatively be a solar panel cleaning apparatus or a building exterior wall cleaning apparatus.

It should be understood that the cleaning assembly 200 may not be limited to the above structure. In other optional embodiments of the present disclosure, the mounting groove 203 may alternatively be provided on the cleaning cloth 21, and the guide bar 211 may alternatively be provided on the support plate 20, as long as the support plate 20 and the cleaning cloth 21 can be easily mounted and removed.

For example, in the embodiments illustrated in FIG. 1 and FIG. 12, the mounting groove 203 is provided at an end portion of a side of the support plate 20 away from the machine body 100, and the guide bar 211 is disposed on a position of the cleaning cloth 21 corresponding to the mounting groove 203, namely an end portion of the cleaning cloth 21. It should be understood that in some other optional embodiments, the mounting groove 203 may alternatively be provided in the middle of the side of the support plate 20 away from the machine body 100, and correspondingly, a position of the guide bar 211 on the cleaning cloth 21 corresponds to the mounting groove 203, which is also at the middle of the cleaning cloth 21.

In the smart cleaning device according to the embodiments of the present disclosure, an end of the mounting groove 203 on the support plate 20 is a mounting end, and the other end thereof is a stop end. The guide bar 211 may penetrate into or get out of the mounting groove 203 through the mounting end 211, and may be prevented from getting out of the mounting groove 203 through the stop end.

In some optional embodiments of the present disclosure, the guide bar 211 may be a plastic rod or a steel rod with a degree of rigidity, or a flexible bar. A cross section of the guide bar 211 may be circular or non-circular. The cross section of the mounting groove 203 on the support plate 20 has a shape of C or a shape similar to C as along as the guide bar 211 can be accommodated and limited therein. An opening of the mounting groove 203 for the cleaning cloth 21 to extend out of the mounting groove 203 is facing downward, i.e., an opening of a C shape is facing downward. An end of the mounting groove 203 is a protruding end without a stop structure for the guide bar 211 to be inserted, and the other end of the mounting groove 203 is a stop end with a stop structure configured to prevent the guide bar 211 from dropping therefrom. That is, an end of the mounting groove 203 is closed and the other end thereof is open. A tail portion of the cleaning cloth 21 is fixedly disposed on the support plate 20 in a manner of matching the guide bar 211 with the mounting groove 203, thereby improving stability of securing and preventing the cleaning cloth 21 from escaping. The guide bar 211 and the mounting groove 203 are located on the support plate 20 in a direction facing a forward direction of the smart cleaning robot 1. The cleaning cloth 21 is ensured to be mounted correctly by virtue of a way of firstly mounting the guide bar 211 and then pasting the cleaning cloth 21 onto a magic tape.

Further referring to FIG. 1 and FIG. 2, the cleaning cloth 21 may be made of a same material as a whole, and may alternatively be composite cleaning cloth 21 made of different materials at various positions. In some optional embodiments of the present disclosure, the cleaning cloth 21 is a composite cleaning cloth 21. A main body of the cleaning cloth 21 has a substantially semi-circular shape, an inner portion thereof is a water-permeable area made of a material with a relatively high water permeability, a middle portion thereof is a decontamination area made of a relative rigid material configured to scrape off harder substances on a floor, and an outer portion thereof is a water-absorbing area made of a material with a good water-absorbing property for absorbing water on the floor to remove water stains. As a result, cleaning deficiency can be improved. The guide bar 211 is disposed on a liner section of the semicircular linear section.

Further referring to FIG. 5 and FIG. 6, in the smart cleaning device according to the embodiments of the present disclosure, a water through hole 206 is provided in the support plate 20 and is configured to communicate water in the water tank 22 onto the cleaning cloth 21. In some optional embodiments of the present disclosure, the water tank 22 may be an electric-control water tank 22 provided with a peristaltic pump, and a water path plate is disposed inside the smart cleaning robot 1. Optionally, the water path plate is a same-course water path plate 25 which is disposed between the machine body 100 and the support plate 20 and is detachably connected to the machine body 100. In addition, a water inlet and a water outlet 251 are provided on the same-course water path plate 25. The water inlet is connected to a water outlet passage of the peristaltic pump inside the water tank 22, and a position of the water outlet 251 is provided corresponding to a position of the water through hole 206 in the support plate 20, so that water in the water tank 22 flows onto the cleaning cloth 21 through the water outlet 251 of the same-course water path plate 25 and the water through hole 206 of the support plate 20.

Further referring to FIG. 1 and FIG. 2, in the smart cleaning device according to the embodiment of the present disclosure, shapes and positions of butt-joint of the water tank 22 and the machine body 100 are correspondingly provided. That is, a shape of a portion of the machine body 100 which is used for docking the water tank 22 corresponds to a shape of the water tank 22. After the water tank 22 is mounted to the machine body 100, an outer side wall of the water tank 22 is matched with a side wall of the machine body 100, and a bottom wall of the water tank 22 is matched with the bottom wall of the machine body 100; and the water tank 22 at least partially surrounds an outer side of the fan in the machine body 100. As illustrated in FIG. 2, the fan is disposed inside the fan mounting position 16. In some optional embodiments of the present disclosure, the water tank 22 is connected to or separated from the machine body 100 through the button 24; a notch 204 configured to receive the button 24 is provided on the support plate 20. For example, the notch 204 is provided on the top of the support plate 20 and is matched with the button 24 in shape. When the cleaning assembly 200 is required to be removed from the machine body 100, the cleaning assembly 200 may be separated from the machine body 100 by pressing the button 24.

Further referring to FIG. 6, in the smart cleaning device according to the embodiment of the present disclosure, in some optional embodiments of the present disclosure, an elastic part 205 is disposed on a surface of a side of the support plate 20 facing the water tank 22. After being mounted on the water tank 22, the support plate 20 is in elastic contact with the water tank 22, so that the water tank 22 floats upward or downward relatively stably. In addition, the elastic part 205 on the support plate 20 abuts against the bottom surface of the water tank 22, so that in operation, pressing force is generated between the support plate 20 and the floor, and the cleaning cloth 21 is made in tight contact with the floor, and thus, a good cleaning effect is achieved. Optionally, the elastic part 205 includes a plurality of elastic buttons which are disposed apart from each other on a baffle plate facing the water tank 22, and springs are disposed inside the elastic buttons, respectively.

It should be understood that the elastic part 205 may be, but not limited to the above structure, and may alternatively be disposed on a surface of a side of the water tank 22 facing the support plate 20; and the elastic part 205 includes a plurality of elastic buttons which are disposed apart from each other on a surface of a side of the water tank 22 facing the support plate 20. Certainly, both the surface of the side of the water tank 22 facing the support plate 20 and the surface of the side of the support plate 20 facing the water tank 22 may further be provided with elastic parts 205; after being mounted on the water tank 22, the support plate 20 is in elastic contact with the water tank 22. In a case that the surface of the side of the water tank 22 facing the support plate 20 and the surface of the side of the support plate 20 facing the water tank 22 are provided with an elastic parts 205, respectively, for example, the elastic part 205 on the surface of the side of the water tank 22 facing the support plate 20 and the elastic part 205 on the surface of the side of the support plate 20 facing the water tank 22 are arranged in a staggered manner, so that a relatively good elastic contact effect is achieved between the water tank 22 and the support part 20.

Further referring to FIG. 1 and FIG. 2, for the smart cleaning device according to the embodiment of the present disclosure, in some optional embodiments of the present disclosure, the machine body 100 includes a sensing system (not shown), a control system (not shown), a drive system 10, a power supply system, a human-machine interaction system, a dry cleaning portion 13, and the like. Various parts of the smart cleaning device will be described below.

In some optional embodiments of the present disclosure, the machine body 100 further includes an upper cover, a front portion, a rear portion, a chassis and the like. The machine body 100 has a substantially circular shape, and may alternatively have other shapes, including, but not limited to, an approximately D shape which has square front portion and a circular rear portion.

The sensing system includes a location determining device located above the machine body 100, a buffer disposed at the front portion of the machine body 100, a cliff sensor and an ultrasonic sensor, an infrared sensor, a magnetometer, an accelerometer, a gyroscope, an odometer, and other sensing devices. These sensing devices provide the control system with various location information and motion status information of the smart cleaning device. The location determining device includes, but is not limited to, an infrared transceiver, a camera and a laser distance sensor (LDS).

The drive system 10 is configured to drive the machine body 100 and components disposed thereon to move for autonomously traveling and cleaning. The drive system 10 includes a drive wheel module 101, and may emit driving instructions based on distance and angle information, such as x, y, and 0 components, to operate the smart cleaning robot 1 to travel across the ground. The drive wheel module 101 may control left and right wheels at the same time. To control the movement of the smart cleaning device more precisely, the drive wheel module 101 includes a left drive wheel module and a right drive wheel module. The left and right drive wheel modules are disposed opposite to each other along a transverse axis defined by the machine body 100. Optionally, the left and right drive wheel modules are disposed symmetrically. To make the smart cleaning robot 1 to move more stably on the ground or to have stronger motion ability, the smart cleaning robot 1 may include one or more driven wheels 102, which include, but are not limited to, a universal wheel.

The drive wheel module 101 includes a traveling wheel, a drive motor, and a control circuit configured to control the drive motor. The drive wheel module 101 may further be connected to both a circuit configured to measure a drive current and an odometer. The drive wheel module 101 may be detachably connected to the machine body 100 to facilitate detachment and maintenance. The drive wheel may have an offset drop-type suspension system, which is fastened to the machine body 100 in a movable manner, for example, rotatably attached to the machine body 100, and configured to receive a spring bias downward and biased away from the machine body 100. The spring bias keeps the drive wheel in contact and traction with the ground with a certain grounding force; and in addition, cleaning elements (such as a brushroll 131) of the smart cleaning robot 1 further contact the floor with a certain grounding pressure.

The front portion 14 of the machine body 100 may carry a buffer 122. In a case that the drive wheel module 101 drive the smart cleaning robot 1 to travel on the floor during a cleaning process, the buffer detects one or more events on a traveling path of the smart cleaning robot 1 through the sensor system, such as an infrared sensor. The smart cleaning robot 1 may control the drive wheel module 101 to respond to events, such as obstacles and walls, detected by the buffer, to for example stay away from the obstacles.

The control system is disposed on a main circuit board of the machine body 100, including a computing processor, such as a central processing unit and an application processor, in communication with a non-transitory memory, such as a hard disk, a flash memory, and a random access memory, and based on obstacle information fed back by the laser distance sensor, the application processor creates an instant map of the environment where the smart cleaning robot 1 is located through a locating algorithm, such as the SLAM. In combination with distance information and speed information fed back by a sensing device, such as the buffer, the cliff sensor 11 and an ultrasonic sensor, an infrared sensor, a magnetometer, an accelerometer, a gyroscope, and an odometer, the control system comprehensively determines which operation state a ground sweeper is currently in, such as crossing a door threshold, climbing on a carpet, being located on a cliff, being stuck above or below, a full dust box, and being picked up, and may further provide a next action strategy for different situations, making operation of the smart cleaning robot 1 meet requirements of a user well, and providing a good user experience.

Further, the control system may plan an efficient and reasonable cleaning path and a cleaning manner based on instant map information created through the SLAM, thereby improving the cleaning efficiency of the smart cleaning robot 1 significantly.

The power supply system includes a rechargeable battery, such as a nickel-metal hydride battery and a lithium battery. The rechargeable battery may be connected to a charging control circuit, a battery pack charging temperature detecting circuit, and a battery under-voltage monitoring circuit, and the charging control circuit, the battery pack charging temperature detecting circuit, and the battery under-voltage monitoring circuit are further connected to a single chip microcomputer control circuit. The smart cleaning robot is connected to a charging station through a charging electrode disposed on a side or bottom of the machine body for charging. If dust is attached to the exposed charging electrode, a plastic body around the electrode will melt and deform due to charge accumulation effect during a charging process, and even the electrode itself will be deformed, so that normal charging cannot continue.

The human-machine interaction system 12 includes a button on a panel of the smart cleaning robot, the button configured for a user to select a function, further includes a display screen and/or an indicator lamp and/or a speaker, the display, the indicator lamp and the speaker presenting the user a current state of the smart cleaning robot or function options, and may further include a mobile phone client program. For a path-guided cleaning device, a mobile phone client may present a user a map of an environment in which the device is located and the location of the smart cleaning robot, and may provide the user with more enriched and more humanized function options.

Further referring to FIG. 3, in order to describe behaviors of the smart cleaning robot 1 more clearly, directions are defined as follows: the smart cleaning robot 1 may travel on a floor through various combinations of movements with respect to following three mutually perpendicular axes defined by the machine body 100: a front-rear axis X (that is, an axis along the front portion 14 and rear portion 15 of the machine body 100), a transverse axis Y (that is, an axis perpendicular to the axis X and on the same horizontal plane with the axis X), and a central vertical axis Z (an axis perpendicular to the plane formed by the axis X and the axis Y). A forward driving direction along the front-rear axis X is referred to as "forward", and a backward driving direction along the front-rear axis X is referred to as "backward". The direction of the transverse axis Y is essentially a direction in which an axis defined by a center point of a drive wheel module 101 extends between a right wheel and a left wheel of the smart cleaning robot 1.

The smart cleaning robot 1 may rotate around the Y axis. "Upward" designates a case that a front portion of the smart cleaning robot 1 is tilted upward, and a rear portion is tilted downward; and "down" designates a case that the front portion of the smart cleaning robot 1 is tilted downward, and the rear portion is tilted upward. In addition, the smart cleaning robot 1 may rotate around the Z axis. In a forward direction of the smart cleaning robot 1, "turn right" designates a case that the smart cleaning robot 1 is tilted to a right side of the X axis; and "turn left" designates in a case that the smart cleaning robot 1 is tilted to a left side of the X axis.

A dust box is mounted in an accommodating cavity by means of mechanical clasp-chuckle, a chuckle shrinks when a clasp is pressed, and the chuckle sticks out and is stuck in a groove in the accommodating cavity.

The above-mentioned cleaning assembly 200 serves as a wet cleaning portion of the smart cleaning robot 1, and mainly serves to mop a to-be-cleaned surface (such as a floor) with a cleaning cloth 21 containing a cleaning liquid. The dry cleaning portion 13 mainly serves to clean solid particulate pollutants on the to-be-cleaned surface by a structure such as a cleaning brush. Functions of the dry cleaning portion 13 is achieved by a second cleaning portion including a brushroll 131, a dust box, a fan, an air outlet, and a connecting component connecting the four. The brushroll 131 with interference with the floor sweeps garbage on the floor, rolls it in front of a dust suction opening between the brushroll 131 and the dust box, and then suctions it into the dust box through a gas flow with a suction force, produced by the fan and passing through the dust box. Dust removal capacity of the smart cleaning robot 1 may be characterized by dust pickup efficiency (DPU) of garbage. The dust pickup efficiency DPU is affected by the structure and materials of the roller brush 131, by a wind power utilization rate of an air duct formed by the dust suction opening, the dust box, the fan, the air outlet and the connecting component connecting the four, and by a type and power of the fan. Compared with ordinary plug-in vacuum cleaners, improvement in dust pickup efficiency is more significant for the smart cleaning robot 1 with limited energy. The improvement in the dust pickup efficiency directly reduces energy requirements, that is, the smart cleaning robot 1 that can clean a floor of 80 square meters with one charge previously can be improved to clean a floor of 100 square meters or more with one charge. In addition, a service life of a battery with reduced charging times may further be greatly prolonged, so that the frequency of battery replacements by a user may further be decreased. More intuitively and importantly, the improvement in the dust pickup efficiency relates to the most apparent and important user experience, and the user may directly draw a conclusion whether sweeping is well done or not/wiping is well done or not. The dry cleaning assembly 13 may further include a side brush 132, a rotating shaft of which that is angled relative to the floor for moving debris into a cleaning region of the brushroll 131 of the second cleaning portion.

The embodiment of the present disclosure further provides a cleaning assembly 200 which may be the above-mentioned cleaning assembly 200.

An embodiment of the present disclosure provides a cleaning assembly and a smart cleaning device having the cleaning assembly, by which, a liquid containing box is not required to be detached when a flexible cleaning body is replaced, and the flexible cleaning body can be dismounted by only dismounting a connecting plate in a forward or backward direction of a machine body, thereby facilitating operating while avoiding damages easily caused to the smart cleaning device by dismounting of the liquid containing box of the prior art.

According to an aspect, an embodiment of the present disclosure provides a cleaning assembly, capable of being mounted on a machine body of a smart cleaning device, where the cleaning assembly includes a connecting plate and a flexible cleaning body, the cleaning assembly is detachably connected to the machine body through a connecting plate, and in a case that the connecting plate is mounted into or dismounted from the machine body, the connecting plate moves in a forward or backward direction of the machine body; the connecting plate and the soft cleaning body are detachably connected through a slide assembly, the slide assembly includes a mounting groove and a guide bar which are mutually matched, the mounting groove is formed in one of the connecting plate and the soft cleaning body, and the guide bar is disposed on the other one of the connecting plate and the soft cleaning body; and the guide bar is capable of penetrating into the mounting groove to connect the soft cleaning body to the connecting plate, and is capable of getting out of the mounting groove to separate the soft cleaning body from the connecting plate.

According to an aspect of the embodiment of the present disclosure, a first end of the mounting groove is a mounting end, and a second end thereof is a stop end; and the guide bar is capable of penetrating into or get out of the mounting groove through the mounting end, and is prevented from getting out of the mounting groove through the stop end.

According to an aspect of the embodiment of the present disclosure, the first end of the mounting groove is open, and the second end of the mounting groove is closed.

According to an aspect of the embodiment of the present disclosure, a liquid containing box is further included, the connecting plate is mounted at a bottom portion of the liquid containing box through a guide structure, and after the connecting plate is mounted at the bottom portion of the liquid containing box, the connecting plate is capable of floating up and down relative to the liquid containing box.

According to an aspect of the embodiment of the present disclosure, an elastic part is disposed on a surface of a side the liquid containing box facing the connecting plate and/or a surface of a side of the connecting plate facing the liquid containing box; and after the connecting plate is mounted at the bottom portion of the liquid containing box, the connecting plate is in elastic contact with the liquid containing box.

According to an aspect of the embodiment of the present disclosure, the elastic part includes a plurality of elastic buttons which are arranged in a spaced mode.

According to an aspect of the embodiment of the present disclosure, the guide structure includes a guide protrusion and a guide groove which are mutually matched, where the guide protrusion is disposed on one of the connecting plate and the liquid containing box, the guide groove is formed in the other one of the connecting plate and the liquid containing box, where a thickness of the guide protrusion is less than a depth of the guide groove.

According to an aspect of the embodiment of the present disclosure, after being mounted on the liquid containing box, the connecting plate is connected to the liquid containing box through a connecting structure; and the connecting structure includes a first connecting structure disposed on the liquid containing box and a second connecting structure disposed on the connecting plate, which are mutually matched.

According to an aspect of the embodiment of the present disclosure, the connecting structure further includes a control structure which is disposed on one of the liquid containing box and the connecting plate, and the control structure is capable of controlling the first connecting structure and the second connecting structure to connect and separate.

According to an aspect of the embodiment of the present disclosure, the control structure is disposed on the connecting plate, and is integrated with the second connecting structure.

According to one aspect of the embodiment of the present disclosure, a mounting opening for allowing the first connecting structure to mount in the connecting plate and connect to the second connecting structure is formed in the connecting plate, where the control structure includes a mounting frame and an operating part, the mounting frame can be movably arranged on the connecting plate, and the second connecting structure is connected to a first end of the mounting frame, so that the second connecting structure can be driven by the mounting frame to move; and the operating part is arranged at a second end of the mounting frame and is opposite to the second connecting structure, so that the mounting frame is conveniently controlled to move by the operating part.

According to an aspect of the embodiment of the present disclosure, a water through hole in communication with the liquid containing box is formed in the connecting plate for communicating water in the liquid containing box onto the soft cleaning body.

According to an aspect of the embodiment of the present disclosure, a shape of a portion of the machine body which is used for docking the liquid containing box corresponds to a shape of the liquid containing box; after the liquid containing box is mounted on the machine body, an outer side wall of the liquid containing box is matched with a side wall of the machine body, and a bottom wall of the liquid containing box is matched with a bottom wall of the machine body.

According to an aspect of the embodiment of the present disclosure, the liquid containing box is detachably connected to the machine body through a button, an opening for receiving the button is formed in the connecting plate, so that the button is operated to control mounting and separating of the liquid containing box and the machine body.

According to another aspect, an embodiment of the present disclosure provides a smart cleaning device, including a cleaning assembly. The smart cleaning device includes a cleaning assembly. The a cleaning assembly, capable of being mounted on a machine body of a smart cleaning device, where the cleaning assembly includes a connecting plate and a flexible cleaning body, the cleaning assembly is detachably connected to the machine body through a connecting plate, and in a case that the connecting plate is mounted into or removed from the machine body, the connecting plate moves in a forward direction or backward direction of the machine body; the connecting plate and the soft cleaning body are detachably connected through a slide assembly, the slide assembly includes a mounting groove and a guide bar which are mutually matched, the mounting groove is provided on one of the connecting plate and the soft cleaning body, and the guide bar is disposed on the other one of the connecting plate and the soft cleaning body; and the guide bar is operatively inserted into the mounting groove to connect the soft cleaning body to the connecting plate, and is operatively get out of the mounting groove to separate the soft cleaning body from the connecting plate.

In the cleaning assembly and the smart cleaning device having the cleaning assembly according to the embodiment of the present disclosure, the cleaning assembly is capable of being mounted on a machine body of the smart cleaning device, the cleaning assembly includes a connecting plate and a soft cleaning body which are detachably connected through a slide assembly, the slide assembly includes a mounting groove and a guide bar which are mutually matched, the mounting groove is formed in one of the connecting plate and the soft cleaning body, the guide bar is disposed on the other one of the connecting plate and the soft cleaning body, and the guide bar is capable of penetrating into the mounting groove to connect the soft cleaning body to the connecting plate, and is capable of getting out of the mounting groove to separate the soft cleaning body from the connecting plate, where the cleaning assembly is detachably connected to the machine body through the connecting plate, and in a case that the connecting plate is mounted into or dismounted from the machine body, the connecting plate moves in a forward or backward direction of the machine body, by which every time a soft cleaning body is replaced, a liquid containing box does not need to be dismounted, and the soft cleaning body can be dismounted by only dismounting a connecting plate in a forward or backward direction of a machine body, thereby facilitating operating while avoiding damages easily caused to the smart cleaning device by dismounting of the liquid containing box of the prior art.

Although the present disclosure has been described with reference to optional embodiments of the present disclosure, variants may be made and equivalents may be substituted for components of the present disclosure without departing from the scope of the present disclosure. In particular, as long as there is no conflict in structure, the technical features mentioned in the embodiments of the present disclosure may be combined in any manner. The present disclosure is not limited to the specific embodiments disclosed herein, and includes all technical solutions falling within the scope of the claims.

What is claimed is:

1. A cleaning assembly, capable of being mounted on a machine body of a smart cleaning device, wherein the cleaning assembly comprises a connecting plate and a soft cleaning body, the cleaning assembly is detachably connected to the machine body through the connecting plate, and in a case that the connecting plate is mounted into or removed from the machine body, the connecting plate moves in a forward direction or a backward direction of the machine body; the connecting plate and the soft cleaning body are detachably connected through a slide assembly which comprises a mounting groove and a guide bar which are mutually matched, the mounting groove is provided on one of the connecting plate and the soft cleaning body, and the guide bar is disposed on the other one of the connecting plate and the soft cleaning body; and the guide bar is operatively inserted into the mounting groove to connect the soft cleaning body to the connecting plate, and operatively gets out of the mounting groove to separate the soft cleaning body from the connecting plate, wherein the cleaning assembly further comprises a liquid containing box, and the connecting plate is mounted at a bottom portion of the liquid containing box through a guide structure; and the liquid containing box is a water tank with an electric controlled pump, and a water path plate is provided inside the machine body, a water inlet of the water path plate being connected to a water outlet passage of the water tank.

2. The cleaning assembly according to claim 1, wherein a first end of the mounting groove is a mounting end, and a second end of the mounting groove is a stop end; the guide bar is operatively inserted into or operatively gets out of the mounting groove through the mounting end, and is prevented from getting out of the mounting groove through the stop end.

3. The cleaning assembly according to claim 1, wherein the first end of the mounting groove is open, and the second end of the mounting groove is closed.

4. The cleaning assembly according to claim 1, wherein after the connecting plate is mounted onto at the bottom portion of the liquid containing box, the connecting plate is capable of floating upward or downward relative to the liquid containing box.

5. The cleaning assembly according to claim 1, wherein at least one of a surface of a side of the liquid containing box facing the connecting plate and a surface of a side of the connecting plate facing the liquid containing box is provided with an elastic part; and after the connecting plate is mounted at the bottom portion of the liquid containing box, the connecting plate is in elastic contact with the liquid containing box.

6. The cleaning assembly according to claim 5, wherein the elastic part comprises a plurality of elastic buttons disposed apart from each other.

7. The cleaning assembly according to claim 1, wherein the guide structure comprises a guide protrusion and a guide groove which are mutually matched; the guide protrusion is disposed on one of the connecting plate and the liquid containing box; and the guide groove is disposed on the other one of the connecting plate and the liquid containing box; wherein a thickness of the guide protrusion is less than a depth of the guide groove.

8. The cleaning assembly according to claim 1, wherein after being mounted on the liquid containing box, the connecting plate is connected to the liquid containing box through a connecting structure which comprises a first connecting structure and a second connecting structure which are mutually matched, wherein the first connecting structure is disposed on the connecting plate, and the second connecting structure is disposed on the liquid containing box.

9. The cleaning assembly according to claim 8, wherein the connecting structure further comprises a control structure which is disposed on one of the liquid containing box and the connecting plate and is configured to control the first connecting structure and the second connecting structure to be connected with each other or to be separated from each other.

10. The cleaning assembly according to claim 9, wherein the control structure is disposed on the connecting plate, and is integrated with the second connecting structure.

11. The cleaning assembly according to claim 10, wherein a mounting opening configured for the first connecting structure to be mounted in the connecting plate and to be connected to the second connecting structure is provided on the connecting plate, wherein the control structure comprises:

a mounting frame, movably disposed on the connecting plate, wherein the second connecting structure is connected to a first end of the mounting frame, so that the second connecting structure moves under drive by the mounting frame; and an operating part, disposed on a second end of the mounting frame and opposite to the second connecting structure, such that movement of the mounting frame is controlled through the operating part.

12. The cleaning assembly according to claim 1, wherein a water through hole in communication with the liquid containing box is provided on the connecting plate and is configured to communicate water in the liquid containing box onto the soft cleaning body.

13. The cleaning assembly according to claim 1, wherein:

a shape of a portion of the machine body which is used for docking the liquid containing box corresponds to a shape of the liquid containing box; and after the liquid containing box is mounted on the machine body, an outer side wall of the liquid containing box is matched with a side wall of the machine body, and a bottom wall of the liquid containing box is matched with a bottom wall of the machine body.

14. The cleaning assembly according to claim 1, wherein the liquid containing box is detachably connected to the machine body through a button, a notch configured to receive the button is provided on the connecting plate, so that the button is operated to mount the liquid containing box on the machine body or to separate the liquid containing box from the machine body.

15. A smart cleaning device, comprising a cleaning assembly capable of being mounted on a machine body of a smart cleaning device, wherein the cleaning assembly comprises a connecting plate and a soft cleaning body, the cleaning assembly is detachably connected to the machine body through the connecting plate, and in a case that the connecting plate is mounted into or removed from the machine body, the connecting plate moves in a forward direction or a backward direction of the machine body; the connecting plate and the soft cleaning body are detachably connected through a slide assembly which comprises a mounting groove and a guide bar which are mutually matched, the mounting groove is provided on one of the connecting plate and the soft cleaning body, and the guide bar is disposed on the other one of the connecting plate and the soft cleaning body; and the guide bar is operatively inserted into the mounting groove to connect the soft cleaning body to the connecting plate, and operatively gets out of the mounting groove to separate the soft cleaning body from the connecting plate, wherein the cleaning assembly further comprises a liquid containing box, and the connecting plate is mounted at a bottom portion of the liquid containing box through a guide structure; and the liquid containing box is a water tank with an electric controlled pump, and a water path plate is provided inside the machine body, a water inlet of the water path plate being connected to a water outlet passage of the water tank.

* * * * *